US008925677B2

(12) United States Patent
Dugan et al.

(10) Patent No.: US 8,925,677 B2
(45) Date of Patent: Jan. 6, 2015

(54) GYPSUM-PANEL ACOUSTICAL MONOLITHIC CEILING

(71) Applicant: USG Interiors, LLC, Chicago, IL (US)

(72) Inventors: Erin Dugan, Grayslake, IL (US); Mark Miklosz, Western Springs, IL (US); Rafael Bury, Wheeling, IL (US); Lee K. Yeung, Vernon Hills, IL (US); William A. Frank, Lake Villa, IL (US); Peder J. Gulbrandsen, Aurora, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 14/135,821

(22) Filed: Dec. 20, 2013

(65) Prior Publication Data

US 2014/0124291 A1 May 8, 2014

Related U.S. Application Data

(63) Continuation-in-part of application No. 13/832,107, filed on Mar. 15, 2013, now Pat. No. 8,684,134, and a continuation-in-part of application No. 13/534,454, filed on Jun. 27, 2012, now Pat. No. 8,770,345.

(51) Int. Cl.

| | |
|---|---|
| ***E04B 1/82*** | (2006.01) |
| ***E04B 2/02*** | (2006.01) |
| ***E04B 1/84*** | (2006.01) |
| ***E04C 2/04*** | (2006.01) |

(52) U.S. Cl.

CPC ..... *E04B 1/8409* (2013.01); *E04B 1/84* (2013.01); *E04B 2001/8495* (2013.01); *E04B 2001/8476* (2013.01); *E04C 2/043* (2013.01)

USPC ..... 181/290; 181/291; 181/293

(58) Field of Classification Search

CPC ..... E04B 1/8409

USPC ..... 181/290, 291, 293; 52/144, 145

See application file for complete search history.

(56) References Cited

U.S. PATENT DOCUMENTS

| | | | |
|---|---|---|---|
| 2,045,311 | A | 6/1936 | Roos et al. |
| 2,126,956 | A | 8/1938 | Gilbert |

(Continued)

FOREIGN PATENT DOCUMENTS

| | | | |
|---|---|---|---|
| DE | 3147174 | A1 | 6/1983 |
| EP | 2591181 | A | 1/2012 |

(Continued)

OTHER PUBLICATIONS

Notification of Transmittal of the International Search Report and the Written Opinion of the International Searching Authority, or the Declaration of PCT/US2014/027518, filed Mar. 14, 2014, International Search Report dated Jun. 26, 2014, Written Opinion of the International Searching Authority.

(Continued)

*Primary Examiner* — Jeremy Luks

(74) *Attorney, Agent, or Firm* — Pearne & Gordon LLP

(57) ABSTRACT

An acoustical panel for forming a monolithic ceiling or wall, the panel extending across a rectangular area, and having a core made primarily of gypsum, the core being essentially coextensive with the panel area such that it has two opposed sides, each of an area substantially equal to the area of the panel, the core having a multitude of perforations extending generally between its sides, the perforations being distributed substantially uniformly across the full area of the core and being open at both sides of the core, the face side of the core being covered by a porous layer, the perforations being optionally restricted at a rear side of the core, the porous layer at the face side of the core being suitable for adherence of drywall joint compound and a water-based non-blocking paint.

10 Claims, 8 Drawing Sheets

(56) References Cited

U.S. PATENT DOCUMENTS

| | | | |
|---|---|---|---|
| 2,307,978 | A | 1/1943 | Williams |
| 2,814,080 | A | 11/1957 | Tvorik et al. |
| 4,040,213 | A | 8/1977 | Capaul |
| 4,135,341 | A | 1/1979 | Johnson et al. |
| 4,222,803 | A | 9/1980 | Kent et al. |
| 4,347,912 | A | 9/1982 | Flocke et al. |
| 4,428,454 | A | 1/1984 | Capaul et al. |
| 4,661,161 | A | 4/1987 | Jakacki et al. |
| 4,830,140 | A | 5/1989 | Fridh et al. |
| 5,178,939 | A | 1/1993 | Caldwell |
| 5,336,318 | A | 8/1994 | Attard et al. |
| 5,397,631 | A | 3/1995 | Green et al. |
| 5,552,187 | A | 9/1996 | Green et al. |
| 5,558,710 | A | 9/1996 | Baig |
| 5,674,594 | A | 10/1997 | Sensenig |
| 5,725,656 | A | 3/1998 | Shimanovich et al. |
| 5,746,822 | A | 5/1998 | Espinoza et al. |
| 6,228,163 | B1 | 5/2001 | Espinoza et al. |
| 6,284,351 | B1 | 9/2001 | Sensenig |
| 6,675,551 | B1 | 1/2004 | Fuchs |
| 7,503,430 | B2 | 3/2009 | Englert et al. |
| 7,661,511 | B2 | 2/2010 | Hasegawa et al. |
| 7,703,243 | B2 | 4/2010 | Baig |
| 7,836,652 | B2 | 11/2010 | Futterman |
| 7,851,057 | B2 | 12/2010 | Englert et al. |
| 7,906,205 | B2 | 3/2011 | Meres |
| 8,100,226 | B2 | 1/2012 | Cao et al. |
| 8,210,310 | B1 | 7/2012 | Yeung et al. |
| 2005/0193668 | A1 | 9/2005 | Hamilton |
| 2005/0211500 | A1 | 9/2005 | Wendt et al. |
| 2007/0051062 | A1 | 3/2007 | Baig et al. |
| 2007/0102237 | A1 | 5/2007 | Baig |
| 2007/0186493 | A1 | 8/2007 | Baig |
| 2008/0245026 | A1 | 10/2008 | Hamilton |
| 2009/0094922 | A1 | 4/2009 | Newton et al. |
| 2010/0300025 | A1 | 12/2010 | Houck et al. |
| 2011/0076470 | A1 | 3/2011 | Zaveri |
| 2012/0240486 | A1 | 9/2012 | Borroni |
| 2013/0133978 | A1 | 5/2013 | Borroni |

FOREIGN PATENT DOCUMENTS

| | | | |
|---|---|---|---|
| GB | 2203772 | A | 10/1988 |
| JP | 58-218538 | A | 12/1983 |
| WO | 2006/067213 | A1 | 6/2006 |
| WO | 2010/105655 | A1 | 9/2010 |

OTHER PUBLICATIONS

Notification of Transmittal of the International Search Report and the Written Opinion of the International Searching Authority, or the Declaration of PCT/US2013/047280, filed Jun. 24, 2013, International Search Report dated Oct. 9, 2013, Written Opinion of the International Searching Authority.

GYPSUM-PANEL ACOUSTICAL MONOLITHIC CEILING

This application is a continuation-in-part of application Ser. No. 13/832,107, filed Mar. 15, 2013, which is a continuation-in-part of application Ser. No. 13/534,454, filed Jun. 27, 2012.

BACKGROUND OF THE INVENTION

The invention relates to building materials and systems and, in particular, to an acoustical panel for constructing monolithic ceilings and interior walls.

PRIOR ART

Sound absorption in buildings is commonly achieved with ceiling tiles carried on a suspended grid. Generally, the sound absorbing capacity of the tiles is achieved by material selection and/or characteristics of the room facing surface. Ceiling tile installations have the advantage of affording ready access to the space above the ceiling, but the divisions between the tiles, even when the grid is concealed, remain visible. Architects and interior designers have long sought a monolithic, texture free look in an acoustical ceiling particularly when there is no expected need for access to the space above the ceiling. Ordinary gypsum panel drywall ceiling construction does not achieve a sufficiently high noise reduction coefficient (NRC) that would qualify as acoustical. Perforated gypsum panels may achieve an acceptable NRC level but they are not monolithic in appearance.

SUMMARY OF THE INVENTION

The invention resides in the discovery that ordinary gypsum panels, such as drywall sheets, can be modified to construct an acoustical ceiling or wall with a monolithic plain face and surprising acoustical properties. Such panels can achieve an NRC of 0.70 or more.

In accordance with the invention, the gypsum core is made with a multitude of perforations or holes distributed throughout its planar area. The perforations or holes are restricted, preferably with a painted non-woven porous scrim fabric or veil at the front face and, optionally, a non-woven porous acoustical fabric at the back side.

The gypsum panel can be made, for example, by perforating standard sheets of drywall and thereafter covering the perforated sides of the sheet with additional laminated sheets or layers. These perforating and laminating steps can be performed by the original manufacturer of the drywall sheets or by a separate entity independent of the original drywall manufacturer.

Variations in the construction of the gypsum panel are contemplated. Common among these variations is a panel with a perforated gypsum core and with a face covered by a structure that is porous while appearing essentially imperforate to the unaided eye.

The disclosed gypsum-based panels can be installed in the same manner or a like manner as ordinary drywall. For ceiling applications, the acoustical panels of the invention can be screwed to a conventional drywall suspension system of grid tees or "hat channels" carried on black iron channels typically used in commercial applications or they can be attached to wood framing more often used in residential construction. Acoustical walls can be built by attaching the inventive acoustical panels to vertical studs, serving as spaced support elements. It will be seen that the inventive panels can be readily taped and painted like ordinary drywall, using the same or similar materials, equipment, tools and skills, to produce a smooth monolithic ceiling or wall.

DESCRIPTION OF THE PREFERRED EMBODIMENTS

Figure 1:
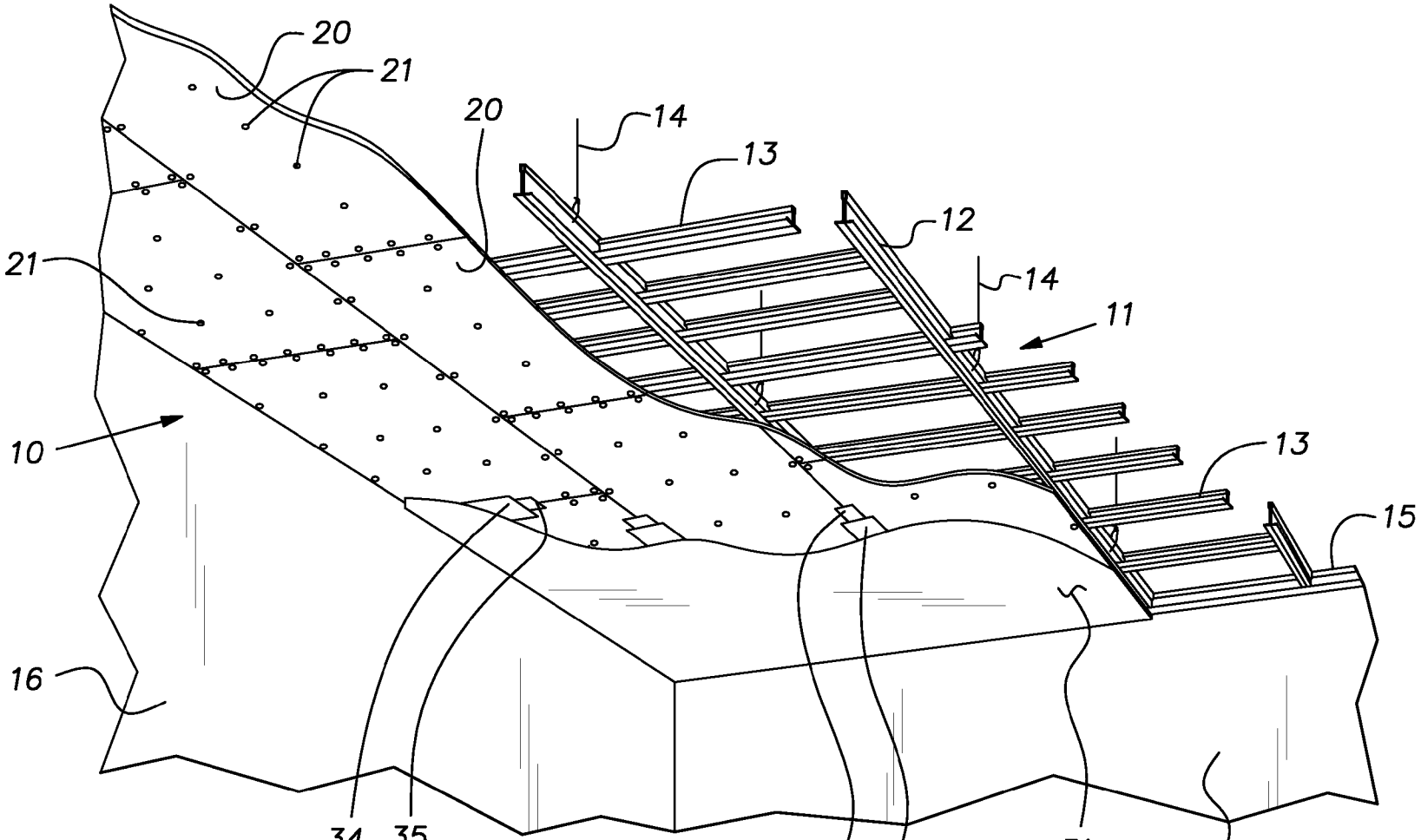
FIG. 1 is a fragmentary, schematic, isometric view of a monolithic acoustical ceiling.

Referring now to FIG. 1, there is shown a schematic partial view of an acoustical monolithic ceiling installation 10. Portions of layers of the ceiling 10 are peeled away to reveal constructional details. The ceiling 10 is a suspended system including a drywall grid 11, known in the art, comprising main tees 12 spaced on 4 ft. centers and intersecting cross tees 13 spaced on 16 in. or 2 ft. centers. Dimensions used herein are typically nominal dimensions and are intended to include industry recognized metric equivalents. The main tees 12, to which the cross tees 13 are interlocked, are suspended by wires 14 attached to a superstructure (not shown). A perimeter of the grid 11 is conventionally formed by channel molding 15 secured to respective walls 16.

Acoustical panels 20 are attached to the lower sides of the grid tees 12, 13 with self-drilling screws 21. The illustrated acoustical panels are 4 ft. by 8 ft. in their planar dimensions, but can be longer, shorter and/or of different width as desired or practical. The size of the panel 20 and spacing of the grid tees 12 and 13, allows the edges of the panel to underlie and be directly attached to a grid tee, assuring that these edges are well supported.

Figure 2:
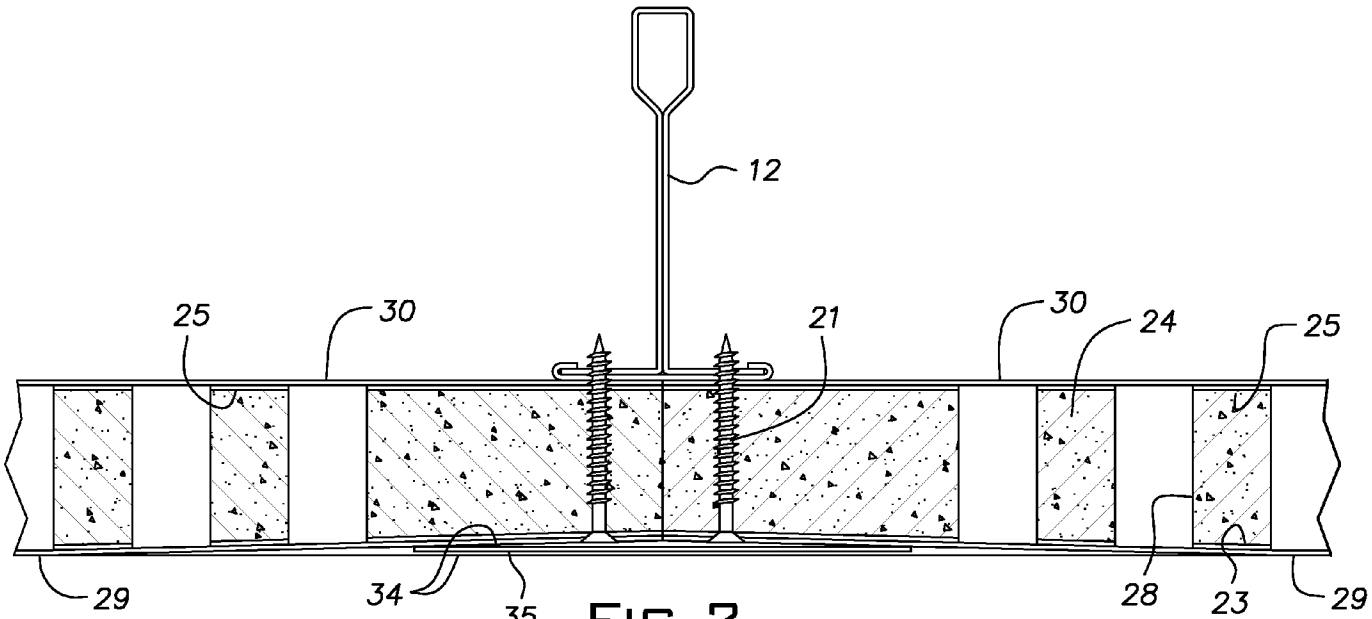
FIG. 2 is a fragmentary, cross-sectional view, on an enlarged scale, of the monolithic ceiling.

Referring to FIG. 2, the acoustical panel 20 of the invention is characterized with a perforated gypsum core 24. One method of providing the core 24 is to modify a standard commercially available sheet of drywall by perforating it through a front paper face 23, the gypsum core 24, and a rear paper side or face 25. Perforations 28 can be formed by drilling, punching, or with other known hole-making techniques. The perforations 28 are preferably uniformly spaced; by way of an example, the perforations can be round holes of 8 mm diameter on 16 mm centers. This arrangement produces a total area of the perforations substantially equal to 20% of the full planar area of a panel 20. Other hole sizes, shapes, patterns and densities can be used. For example, tests have shown that a hole density of 9% of the total area can achieve good results. Marginal areas, as well as intermediate areas corresponding to centers of support grid, joists, or studs, of a sheet can be left unperforated to maintain strength at fastening points.

Sheets 29, 30 are laminated to both full sides of the perforated drywall sheet thereby at least partially closing both ends of the perforations 28. At a rear side of the drywall, the backer sheet or web 30 is preferably an acoustically absorbent non-woven fabric known in the acoustical ceiling panel art. By way of example, the backer fabric can be that marketed under the trademark SOUNDTEX® by Freudenberg Vliesstoffe KG. It has a nominal thickness of 0.2 to 0.3 mm and a nominal weight of 63 g/m$^2$. Specifically, the main components of this non-woven fabric example are cellulose and E-glass with a synthetic resin binder such as polyacrylate, poly(ethylene-CO-vinylacetate). Alternatively, for example, the backer sheet 30 can be a porous paper layer. The sheet 30 can be provided with a suitable adhesive for binding it to the rear paper side 25 of the modified drywall sheet 22.

At a front side of the drywall sheet 22, a sheet or web in the form of a non-woven fabric scrim layer 29 is attached with a suitable adhesive. The facing layer or sheet 29 is porous; a suitable material for this application is that used commercially as a cover or face for conventional acoustical ceiling panels. An example of this type of veil material is that marketed by Owens Corning Veil Netherlands B.V. under the product code A125 EX-CH02. This scrim fabric comprises hydrated alumina fiberglass filament, polyvinyl alcohol, and acrylate copolymer. The unpainted scrim 29 has a nominal weight of 125 g/m$^2$ and an air porosity, at 100 Pa, of 1900 l/m$^2$ sec. To avoid blocking the face scrim 29, the adhesive can be initially applied to the panel or sheet 22. The facing sheet 29 should be sufficiently robust to withstand field finishing operations described below. It should also be compatible with drywall joint compound or similar material and commercially available paints, typically water-based paints such as that described below.

Other usable veils 29 include the non-woven, glass fiber products marketed by Owens-Corning Veil Netherlands B.V. as A135EX-CY07 (nominal weight 135 g/m$^2$, air porosity at 100 Pa of 1050 l/m$^2$/sec) and A180EX-CX51 (nominal weight 180 g/m$^2$, air porosity at 100 Pa of 600 l/m$^2$/sec). All of the described veils are translucent and are incapable of visually concealing the perforations 28 unless painted or coated with a coating such as disclosed herein.

The panel 20 with other identical panels is hung on the grid 11 in the same manner as ordinary drywall is installed. Similarly, as shown in FIG. 1, joints 33 are taped in the same way as regular drywall is taped. Drywall joint compound or similar material 34 is used to adhere a tape or similar material 35 to adjacent margins of two abutting panels 20 by applying it directly to the sheets 29 and over the tape 35 to conceal the tape. Typically, the long edges of the panels 20 are tapered to receive the joint tape 35 below the plane of the major part of the panel faces. The joint compound 34 can be conventional drywall joint compound and the tape 35 can be conventional drywall paper or mesh tape. The screws 21 securing the panels 20 to the spaced support elements 12, 13 forming the grid 11 are countersunk, as is conventional in drywall construction, and are concealed with joint compound 34 applied with a taping knife or trowel in the same manner as if applied to ordinary drywall. The panels 20 can be adhesively attached to vertical stud supports when constructing a wall. When dry, the joint compound 34 can be sanded or wet sponged to blend it into the plane of the surface of the face sheet 29.

After the joint compound 34 has been sanded or sponged smooth, the front sheets 29 and remaining joint compound are painted with a commercially available acoustical paint 31 used for painting acoustical tile. An example of a suitable water-based paint, sometimes referred to as a non-blocking paint, is available from ProCoat Products, Inc. of Holbrook, Me. USA, sold under the trademark ProCoustic. An alternative non-blocking or non-bridging acoustically transparent paint or coating 31 can have the following formulation:

| Ingredient | Percentage By Weight | Function |
|---|---|---|
| Water | 61.5 | Solvent |
| Surfactant | 0.003 | Surfactant for TiO2 |
| Starch Thickener | 0.8 | Viscosity modifier |
| Latex Emulsion | 5.0 | Binder |
| Biocide | 0.2 | Preservative |
| Perlite | 7.5 | Aggregate |
| TiO2 | 25.0 | Whitening agent |

The optimal perlite aggregate particle size distribution for this coating is centered around 10-100 mesh for between 60%-80% of its volume, packing density can range from 6 to 8 lbs/cubic foot. The coating 31 can be applied in two coats at a total of 40 to 160 g/square foot, wet with a coverage of about 80 g/square foot being ideal.

The particulate of this coating formulation can produce a slightly textured appearance equal to that of medium to coarse sandpaper lying between about 30 and about 60 grit (by CAMI and FEPA Standards). This low texture can serve to visually effectively conceal the joints between panels. To improve the uniformity of the finished appearance of the ceiling, the taped joints can be covered with strips of the veil fabric 29, wide enough to cover the joint compound, prior to painting. The paint application should leave as much porosity through the layer 29 as is desired but leave the appearance of an essentially imperforate surface to the unaided eye so that the perforations 28 are not seen. More specifically, the paint or coating 31 should be of a non-bridging or non-blocking type capable of wetting the fibers of the veil 29 but not creating a film that bridges from fiber to fiber of the veil. Alternatively, where high NRC is not necessary, satisfactory results can be obtained by using a conventional primer and a coat of interior latex paint 31 to complete the installation of the ceiling 10. When the term monolithic is used herein, it is to denote that essentially the entire visible surface of a ceiling or wall appears to be a seamless expanse without joints.

A ½ or ⅝ in. drywall-based panel 20, having the described perforation arrangement and front and rear sheets 29, and customary space behind the panel can exhibit NRC values up to and above 0.70, a rating equal to the performance of better-grade acoustical ceiling tile.

Presently, the preferred characteristics of the gypsum-based core 24 are:

Thicknesses: 0.5-0.625 in. preferable,
optional ⅜ in. to 1 in.
Open area: 9.6-27.7%
Hole diameters: 6-12 mm.
Hole spacing: 15-25 mm.

Following are airflow characteristics of the backer layer 30 of the non-woven SOUNDTEX® material described above and the face layer 29 of the first non-woven scrim material described above before and after painting with a proprietary acoustical coating and the acoustical ProCoustic coating.

| | in. thick | U l/min. | P in. $H_2O$ | v mm/s | U $m^3/s$ | P Pascal | Airflow Resistance R mks acoustic ohms, (Pa · s/$m^3$) | Specific Airflow Resistance r mks rayls, (Pa · s/m) | Airflow Resistivity $r_o$ mks rayls/m, (Pa · s/$m^2$) | Airflow Resistivity $r_o$ MPa · s/$m^2$) |
|---|---|---|---|---|---|---|---|---|---|---|
| Backer | 0.009 | 2.00 | 0.0156 | 16.4 | 3.33E−05 | 3.9 | 116,574 | 236 | 1.09E+06 | 1.09 |
| Unpainted Scrim | 0.019 | 2.00 | 0.0027 | 16.4 | 3.33E−05 | 0.7 | 20,176 | 41 | 8.47E+04 | 0.08 |
| Painted Scrim w/ Proprietary Coating | 0.020 | 2.00 | 0.0143 | 16.4 | 3.33E−05 | 3.6 | 106,859 | 217 | 4.26E+05 | 0.43 |
| Painted Scrim w/ ProCoustic | 0.020 | 2.00 | 0.0144 | 16.4 | 3.33E−05 | 3.6 | 107,606 | 218 | 4.29E+05 | 0.43 |

The tables printed below show NRC values for the inventive board and boards of other constructions for comparison purposes. As in the preceding table, unless otherwise noted, the backer is the SOUNDTEX® material and the face is the first scrim identified above.

Test I:

Perforated Panel=⅝ in. FC30 (drywall) with ⅜" diameter perforations, 16 mm o.c. spacing—27.7% open area

| Panel Configuration | NRC Mounting | 4FA | NRC |
|---|---|---|---|
| A Perforated panel only | E400 | 0.1967 | 0.20 |
| B Panel + backer | E400 | 0.6572 | 0.65 |
| BB Panel + backer used as unpainted face | E400 | 0.6215 | 0.60 |
| H Panel + backer + unpainted scrim face | E400 | 0.7442 | 0.75 |
| I Panel + backer + painted scrim Face | E400 | 0.7314 | 0.75 |
| E Panel + backer + paper face | E400 | 0.1978 | 0.20 |
| F Panel + backer + painted paper face | E400 | 0.2963 | 0.30 |
| G Panel + painted scrim face | E400 | 0.5772 | 0.60 |
| K Panel + painted scrim face + unpainted scrim backer | E400 | 0.6376 | 0.65 |
| C Panel + unpainted scrim face | E400 | 0.4028 | 0.40 |

Test II:

Perforated Panel=½ in. Ultralight (drywall) with 6 mm diameter perforations, 15 mm o.c. spacing, 1.5 in. borders—hole pattern=12.6% open area, overall panel=9.6% open area

| Panel Configuration | NRC Mounting | 4FA | NRC |
|---|---|---|---|
| Perforated panel only | E400 | 0.1937 | 0.20 |
| Panel + backer + unpainted scrim face | E400 | 0.5947 | 0.60 |
| Panel + backer + painted scrim face | E400 | 0.4825 | 0.50 |

Test III:

Panel A (small holes)=½ in. Knauf 8/18R with 8 mm. diameter round perforations, 18 mm o.c. spacing & no borders—15.5% open area Panel B (large holes)=½ in. Knauf 12/25R with 12 mm. diameter round perforations, 25 mm o.c. spacing & no borders—18.1% open area

| Panel Configuration | NRC Mounting | 4FA | NRC |
|---|---|---|---|
| Panel A only (with backer) | E400 | 0.6480 | 0.65 |
| Panel B only (with backer) | E400 | 0.7191 | 0.70 |
| Panel A + backer + unpainted scrim face | E400 | 0.6245 | 0.65 |
| Panel B + backer + unpainted scrim face | E400 | 0.6810 | 0.70 |
| Panel A + backer + painted scrim face | E400 | 0.5782 | 0.60 |
| Panel B + backer + painted scrim face | E400 | 0.5652 | 0.55 |
| Panel A + backer + painted scrim face over 1 in. fiberglass panel | E400 | 0.6192 | 0.60 |
| Panel B + backer + painted scrim face over 1 in. fiberglass panel | E400 | 0.6031 | 0.60 |

Panel E of Test I had a heavy manila paper face with a basis weight of 263.50 gm/$m^2$, a caliper of 17.22 mils, a density of 0.60 c/$m^3$ and a porosity of 58.97 seconds. This test sample illustrates that a face, although porous, but with too high an air flow resistivity is unsuitable for use with the invention. Panel BB of Test I indicates that a face with a higher air flow resistivity (see above table) than a painted scrim face can achieve a satisfactory NRC.

The acoustical panel of the invention can be manufactured in additional ways and with different constructions, but maintaining the perforations effectively restricted on at least the face (room) side of a completed panel. For example, where high NRC values are not needed, the rear layer 30 may be omitted. Porous paper may be substituted for either of the non-woven layers 29, 30.

Figure 3:
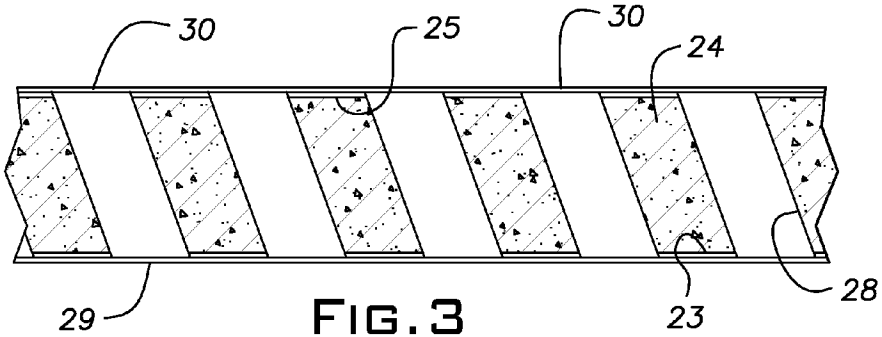
FIG. 3 is a fragmentary, enlarged, cross-sectional view of a modified form of an acoustical panel of the invention.

It has been further discovered that NRC can be measurably increased by orienting the perforations obliquely to the plane of the panel. Such a construction is illustrated in FIG. 3. The perforations 28 can, for example, be oriented at 20 degrees off a line perpendicular to the plane of the panel. The reason or reasons for this improved acoustical performance is not presently completely understood, but could be the result of a greater perforation volume and/or internal reflection of sound waves due to the oblique angle, and/or a greater effective open area at the face.

Figure 4:
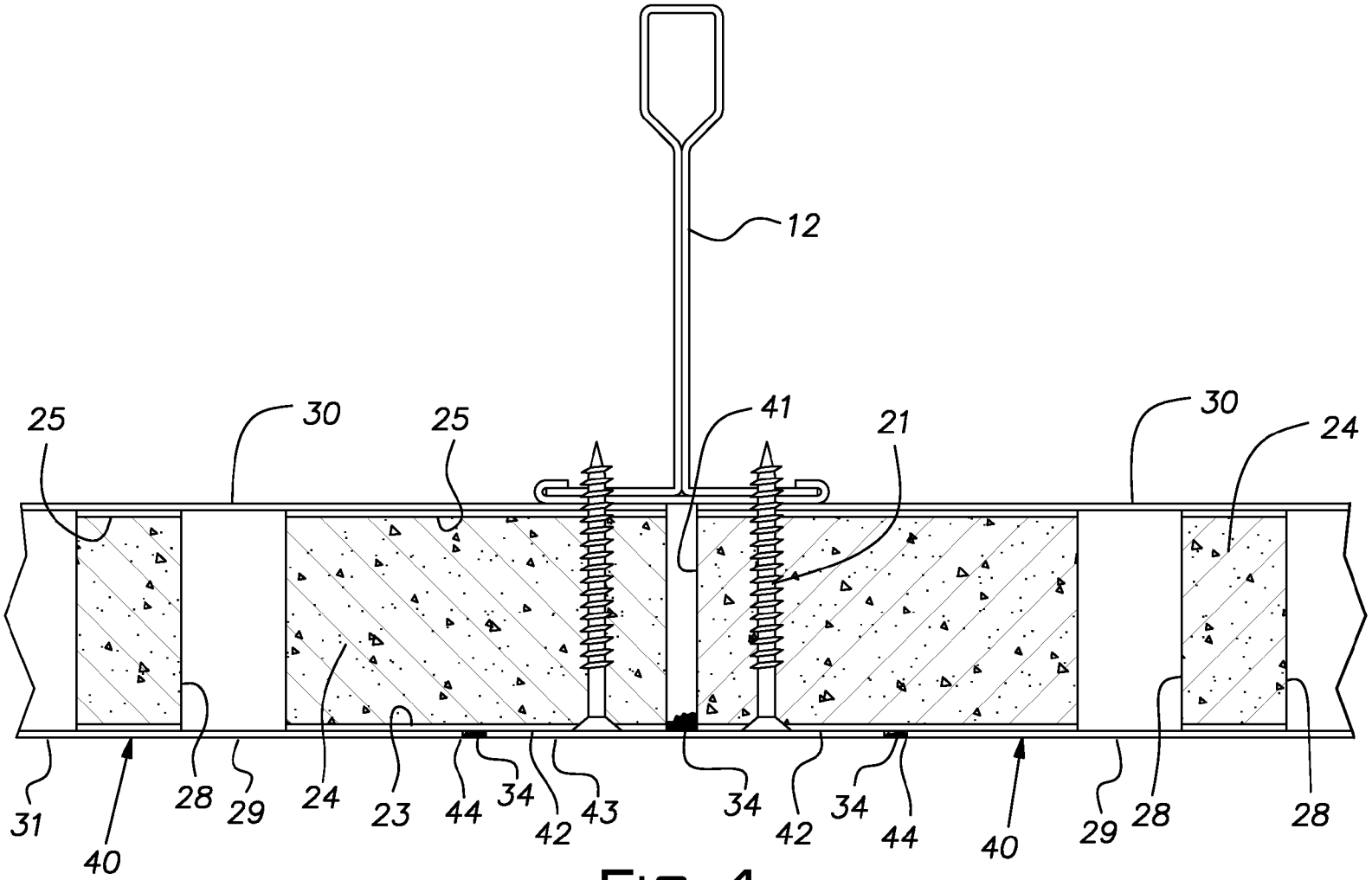
FIG. 4 illustrates a modified panel joint construction.

Referring to FIG. 4, an alternative joint construction is illustrated where edges 36 of two adjacent panels 40 are shown in cross-section. The same reference numerals are used in FIG. 4 as used in FIG. 2 for identical elements. The panels 40 are the same as the panels 20 except that they are of the "square edge" type where the margins of the long panel edges are not tapered to receive a tape as they are on the panels 20. The glass fiber veil 29, which is adhered to the paper face 23 with a suitable adhesive such as an emulsion of polyvinyl acetate, marketed under the mark ELMERS® by Elmer's Products, Inc. The veil 29 is dimensioned so that it is spaced, for example, 1 inch, from the edge of a panel leaving a margin 42. Any narrow gap 41 that exists between the panels 40 that is either unavoidable or intentional can be partially or substantially completely filled with drywall joint compound 34 which, preferably, is a setting, non or low shrinkage, sandable type such as disclosed in the following patents: U.S. Pat. No. 6,228,163; U.S. Pat. No. 5,746,822; U.S. Pat. No. 5,725,656; U.S. Pat. No. 5,336,318; and U.S. Pat. No. 4,661,161. The gap 41 is filled by the joint compound 34 flush with the outer surface of the front paper face 23. Alternatively, the gap 41 can be left without partially or fully fitting it with joint compound.

A tape 43 made of the same material as the veil 29 can advantageously be used to span the joint or gap 41 between the panels 40. The width of the tape 43 is less than the combined width of the marginal areas 42 of the panels. Where the panel margins 42 uncovered by the veil 29 are 1 inch wide, the veil tape 43 can be, for example, 1¼ inch wide. The tape 43 can be adhered, for example, by the same adhesive used to join the veil 29 to the paper face 23 or with joint compound.

Use of square edge drywall panels 40 and non-shrinking settable joint compound reduces the time and labor in constructing a ceiling or wall of the invention. The spaces between the longitudinal edges of the tape 43 and edges 44 of the panel veils 29 can be filled with joint compound, preferably of the quick-setting, non-shrinking type. The veil 29, 43 covering the panels 40 is then coated, preferably by spraying, with one of the paint or coating materials 31 described above.

Figure 5:
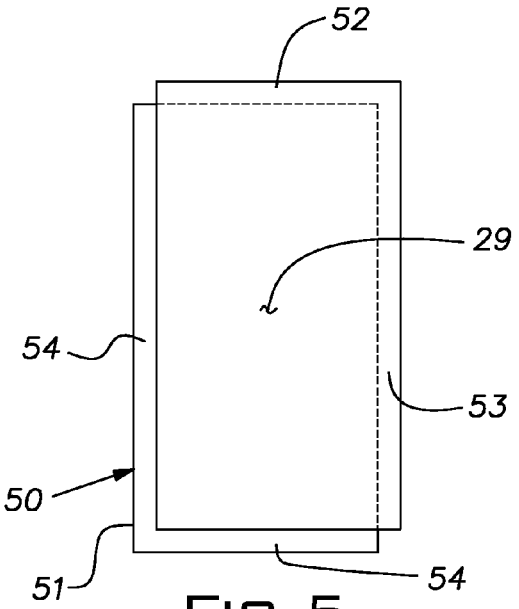
FIG. 5 illustrates an aspect of the invention where the veil or scrim attached to one rectangular panel is staggered to overlap the joints of the panel with two adjacent panels.
Figure 6:
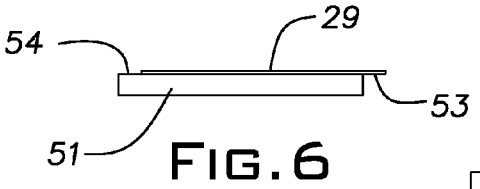
FIG. 6 is an edge view of the panel of FIG. 5.
Figure 7:
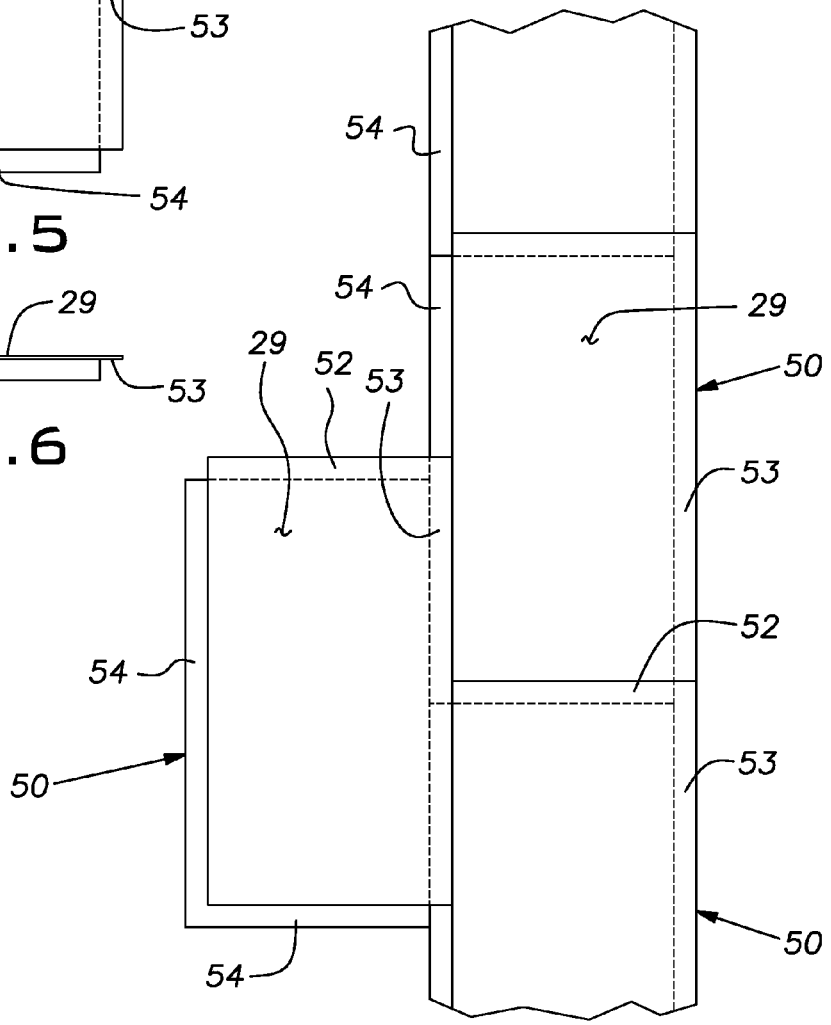
FIG. 7 shows a plurality of the panels of FIG. 6 in an assembled relation.

FIGS. 5-7 illustrate a modified acoustical panel 50 that differs only from the panel 40 described in connection with FIG. 4 by the size and position of the veil 29. The veil 29 is slightly smaller in its planar dimensions than the corresponding planar dimensions of the rectangular main body or remainder 51 of the panel 50 to which it is adhered. Additionally, the veil 29 is offset from the main body 51 along two intersecting edges 52, 53 so that these edges are cantilevered or free and not directly adhered to the main body.

The panel 50 is assembled with identical panels to construct a wall, ceiling or like acoustical barrier. Cross joints associated with the edges 52 can be staggered in relation to adjacent panels joined at edges 53. It will be seen that the cantilevered part or edge 52 and 53 of the veil 29 bridges the actual joint existing between the main bodies 51 of adjacent, abutting panels. Prior to placement of a panel 50 that will provide an overlying veil edge 52, 53, marginal areas 54 not covered by the veil 29 of a previously placed panel 50 are coated with a suitable adhesive, such as discussed above. After placement of this next panel 50, its free veil edges 52, 53 can be pressed on the adhesive on the margins 54 of the previously placed panels 50. The offset veil arrangement of the panel 50 can eliminate the labor of taping joints between panels and has the potential of producing joints that are invisible or nearly invisible to the eye of an observer. Only a very small gap, generally equal to the selected small difference in the size of the veil 29 compared to the main body 51, will be present between adjacent edges of the veils of joined panels 50. While the various FIGS. illustrate rectangular panels that are larger in one planar dimension than a perpendicular dimension, it is to be understood that square panels are intended to be covered within the meaning of the term "rectangular".

Figure 8:
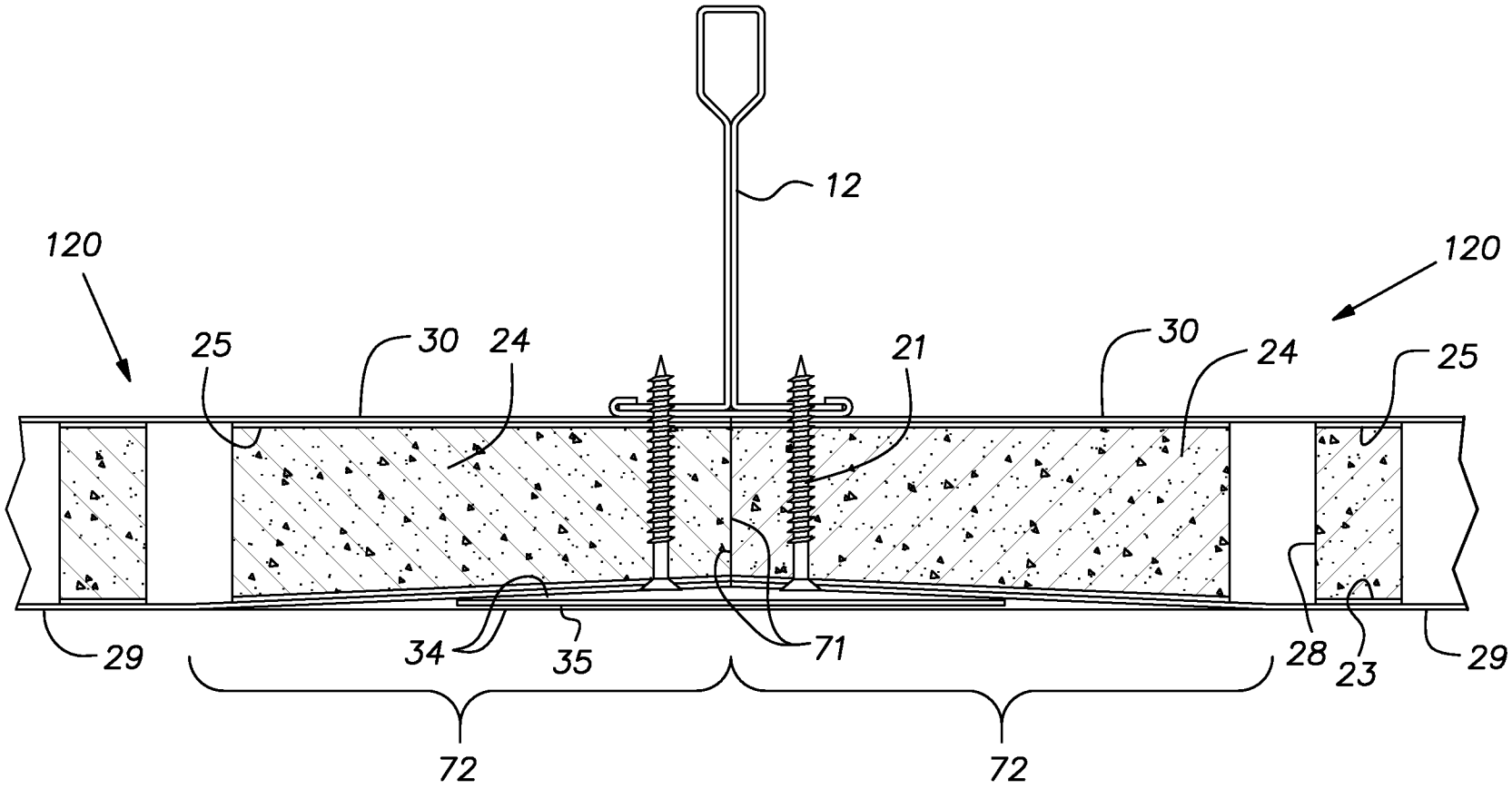
FIG. 8 is a cross-section of a butt joint between a pair of acoustical panels constructed in accordance with the invention.

It is desirable for aesthetic and performance reasons that a finish coating applied in the field to the installed and taped panels 20 be relatively smooth with little or no texture. With this smooth finish requirement, it can be difficult to conceal the end joints between panels 20 particularly in a ceiling where glancing light rays are especially revealing. A further constraint is a need to limit the width of the joint compound at a joint so that the sound absorbing face area of the panels 20 is not significantly covered by joint compound and thereby diminished in performance. Ordinary commercially available drywall presents a particularly difficult problem where the ends of the panels are devoid of a taper. It is customary to produce drywall sheets (wall board) with a taper along their long edges but not on the short edges. When drywall panels are abutted end-to-end, they form at their short non-tapered edges what is known in the industry as a "butt joint". In practice, it is impossible to conceal a taped butt joint in a narrow pattern of joint compound with a no or low texture finish coat. In one aspect of the invention, the drywall panels are modified at their butt joint ends to provide a depression at the outer face associated with the veil 29 for reception of joint tape 35 and joint compound 34. Several alternative constructions are contemplated. Acoustical panels illustrated in FIGS. 8-10 have essentially the same construction as those described in connection with FIG. 2 except for their butt end construction. The panels, unlike the earlier described panels 20, have a taper on all four edges. A depressed surface area or taper of, for example, between about 1¾ inches to about 2 inches in width and at least about 1/32 inch and preferably about 5/64 inch at the deepest measured from the front face of the panel is useful.

One manner of affording a taper at butt ends 71 of a panel 120 is by permanently compressing both ends of the panel to form a narrow depression or taper 72 along the length of the butt end. This compression is essentially limited to the gypsum core 24 which as originally produced has an air content enabling it to be compressed. The compressed gypsum core 24 at the depression or taper 72 has a corresponding increase in density relative to the remainder of the gypsum in the core. The step of permanently compressing the butt ends 71 of the panel 120 can be done when or after the veil 29 is laminated to the paper face 23 or simultaneously in a machine when perforations or apertures 28 are punched, drilled, or otherwise formed in the panel 120.

Another production manner of forming a tapered geometry at the front face of the panel 20 at the butt end 71 is to machine away or otherwise remove some of the gypsum core beneath the front paper face 23, in the manner of a rabbet or kerf extending inwardly from the butt end, and adhering the paper and any gypsum attached thereto onto the undisturbed underlying zone of the gypsum core 24 at the rabbet or kerf.

Figure 9A:
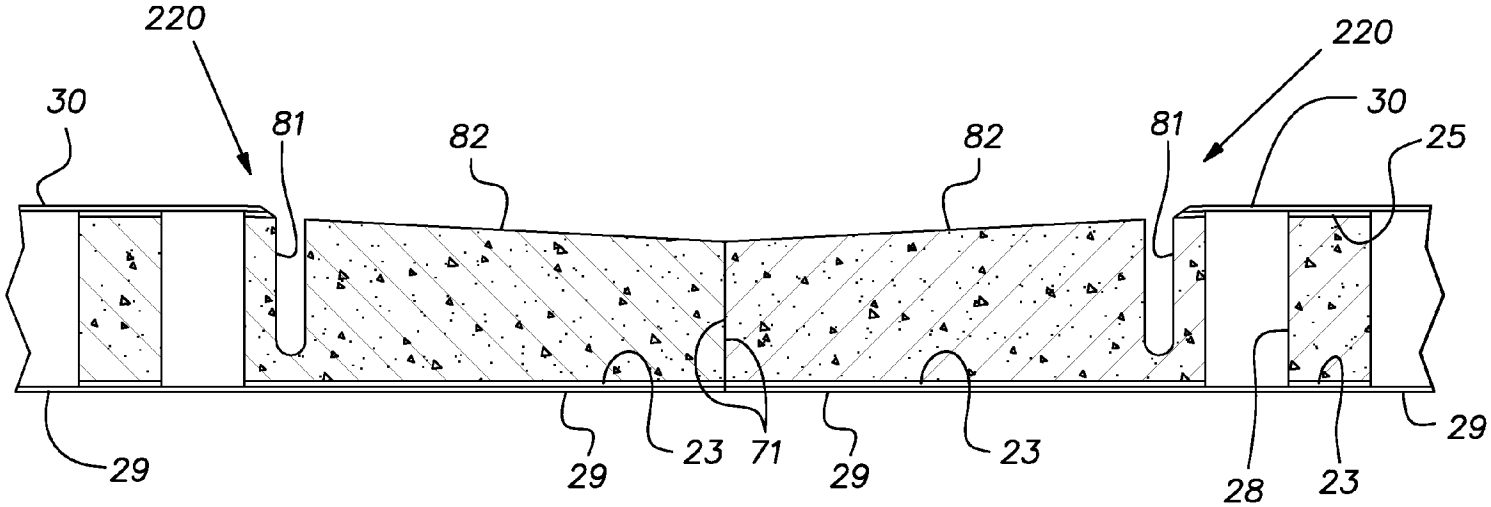
FIG. 9A is a cross-section of a pair of abutted acoustical panels having a modified end construction.
Figure 9B:
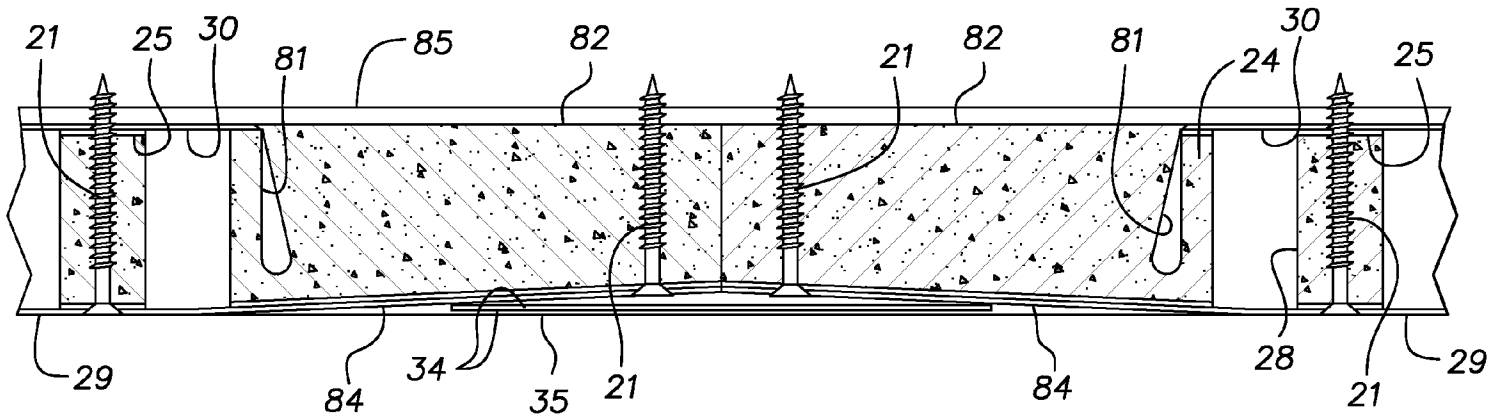
FIG. 9B is a cross-section of the panels of FIG. 9A in a fully installed condition.

FIGS. 9A and 9B illustrate another manner of making a butt edge with a depression or taper at the front face of an acoustical panel 220 of the invention. The panel 220 is otherwise of the same construction as that described in connection with the panel 20 of FIG. 2. The panel 220 is shown in its manufactured state in FIG. 9A. A deep kerf 81 is cut across the full width of the back face of the panel 220 at both panel butt ends and a chamfer 82 is cut from the kerf to the edge plane of the panel at both butt ends 71. FIG. 9B shows the panel 220 in an installed state where screw fasteners 21 have drawn a local strip of the panel at the butt end towards the plane of the rear face of the panel. In the illustrated example, the butt ends 71 of a pair of panels 220 underlie a supporting backing plate 85, disposed between unseen grid tees or other frame elements, into which the fasteners 21 are driven to draw the panel ends against the plate. The result is a surface area 84 that tapers from the plane of the front face of the panel 220 towards the plane of the rear face with increasing proximity to the butt end 71.

Figure 10:
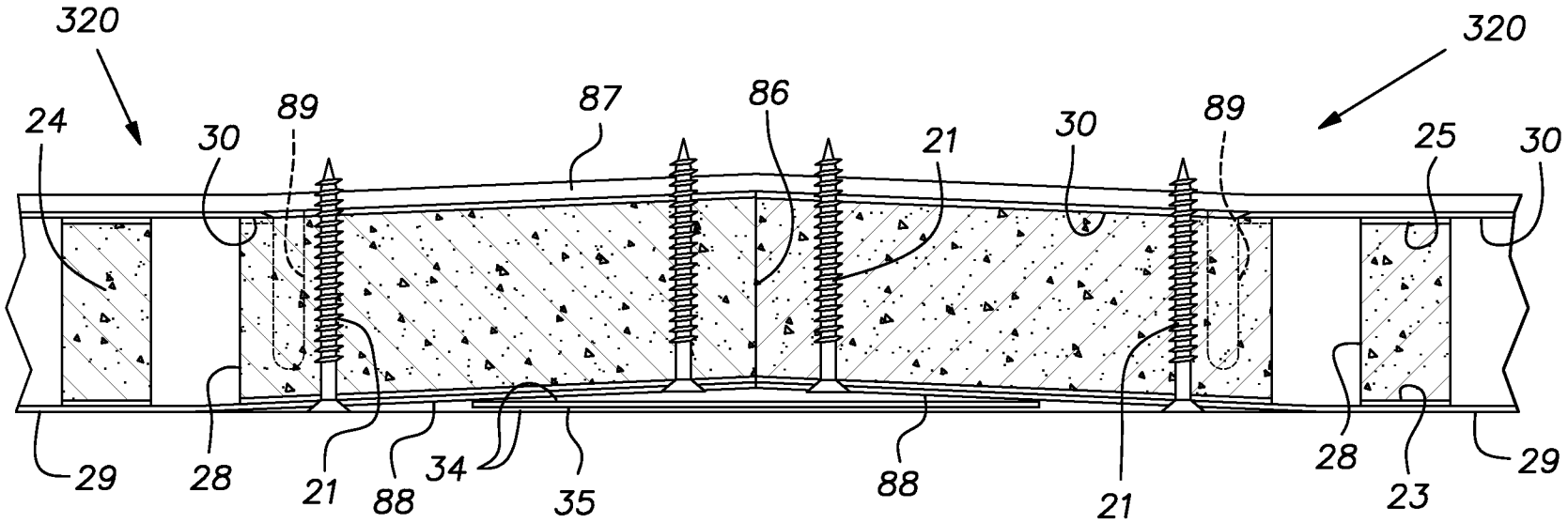
FIG. 10 is a cross-section of a pair of end joined acoustical panels and an associated backer plate.

An alternative manner of establishing an inwardly tapering face surface adjacent the butt end 71 of a gypsum drywall based acoustical panel 320 is illustrated in FIG. 10. A joint 86 between two panels 320 is arranged to fall between two adjacent support or frame elements 13 rather than at a single support element (as shown at 13 in FIG. 1). A shallow U or V-shaped backer plate 87 is located at the rear faces of the panels 320. The backer plate 87, as shown, is a metal plate but can be of wood or other suitable material. Screw fasteners 21 attaching the panels 320 to the backer plate 87 locally bend the panels inwardly thereby creating a surface area 88 tapering inwardly from the plane of the main face area of the panels 320 adjacent the butt ends 71 of each of the abutted panels. The result leaves the butt joint with a depressed zone that can fully receive a joint tape and joint compound.

Drywall panels used to form the acoustic panels of the invention may be originally produced by pressing the gypsum core 24 and paper face 23 as the gypsum sets in its di-hydrate state at the area that will ultimately be cut into butt ends on the drywall production line.

Figure 11:
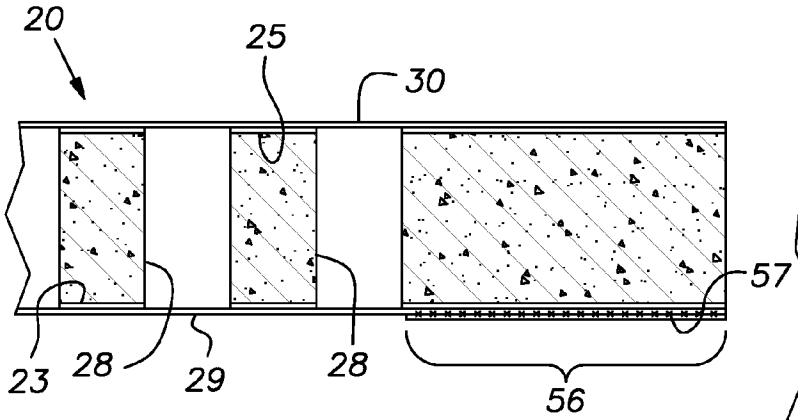
FIG. 11 is a fragmentary cross-sectional view of a paper covered gypsum board based acoustical panel of the invention having a water-resistant material applied to the marginal area of its face.

Acoustical panels like those described in connection with FIGS. 1 and 2 can be joined without the use of joint tape with the goal of avoiding conspicuous taped butt joints. For example, the perimeter of the drywall panels can be routed at their outer faces and the grooves formed by adjacent panel edges can be filled with joint compound. It can be difficult to produce an invisible or essentially invisible joint between routed edge drywall panels even after the joint is sanded, filled, and re-sanded one or more times and eventually painted. It is believed this difficulty of concealing a joint is at least partially the result of the paper face 23 of the drywall swelling upon exposure to the water contained in the joint compound 34. Where it is desirable to use a joint compound 34 containing water with the inventive acoustical panel 20, it can be advantageous to produce a panel 20 with a facing 23 that does not readily swell when it is exposed to joint compound. Resistance to water-induced swelling can be achieved by treating margins 56 (FIG. 11) of the front paper face 23 of the drywall sheets 22 (comprising the core 24 and paper layers 23, 25) to render them resistant to water absorption. Since only the joints are of greatest concern, the water resistance need only be imparted to the margins 56 of the face or room side of a panel 20. However, it is recognized that the entire front paper face 23 on the gypsum board core 24 may be treated or otherwise provided to be water-resistant to resist the tendency to permanently swell upon application of joint compound. The face sheet 23 can be considered water-resistant for the purposes of the present invention if its edges do not swell more than 0.005 inches upon the application of water carrying joint compound.

The marginal face area 56 (FIG. 11) of a paper clad gypsum board can be treated to render it water-resistant and thereby swell resistant by applying a suitable material 57 such as: UV curable paint, siloxane, wax, silicone, a solvent-base quick-drying binder, a two-component coating system, and polyurethane. This list is exemplary and other effective materials exist. The water-resistant material 52 can be roller-coated, sprayed, or flooded onto the paper face or sheet 23, for example.

An alternative approach to reduce or eliminate swelling of the front paper face 23 is the use of a low water absorption manila paper or other type of waterproof paper made with special coatings and fibers that render the face sheet water-resistant.

By marginal areas 57 of the panel 22 it is meant those areas, which may be tapered, that are intended or expected to be coated with joint compound to conceal a joint formed between edges of adjacent panels. The non-swelling water-resistant panels described herein, typically, have the same through hole pattern described hereinabove as well as the same suitably adhered non-woven veil outer face layer 29 and non-woven rear layer 30.

Figure 12A:
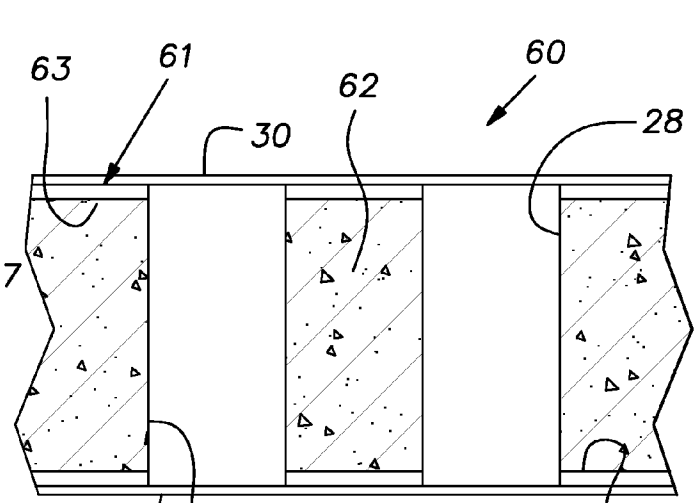
FIG. 12A is a fragmentary sectional view of one of the acoustical panels of FIG. 12 on an enlarged scale.
Figure 12:
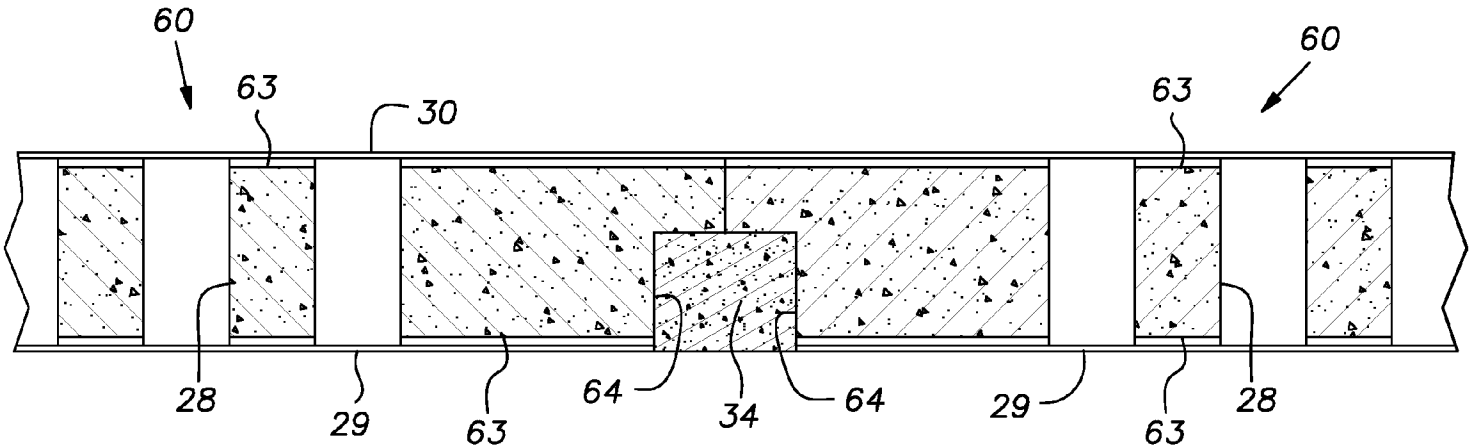
FIG. 12 is a fragmentary cross-sectional view of a joint between two acoustical panels, each including a glass fiber/resin mat faced gypsum core.

An alternative gypsum board construction is illustrated in FIGS. 12 and 12A. Fragmentary edge portions of joined gypsum-based acoustical panels 60 are shown in FIG. 12. A panel 60 can be made using a roof board 61 such as that marketed under the trademark SECUROCK® by United States Gypsum Company. The board 61 has a core 62 of gypsum sandwiched between a pair of glass fiber mats or layers 63. Such roof boards 61 are available in ½ inch thick, 4 foot by 8 foot panels (or their industry metric equivalent). All four edges of the panel 60 are routed to form a rabbet 64 at the front face. As in the case of the earlier described panels 20, the board 61 is through-perforated with holes 28 existing substantially over its complete face area. By way of example, the board 61 can have a perforation hole pattern as follows: ⅜ diameter, approximately ¾ inch spacing with 1.5 inch unperforated borders. The rabbeted face is covered with the above-described veil 29 and the non-rabbeted face is covered with the above-described backer sheet or web 30. The panel 60 is attached to a supporting structure as previously described with screws or the like. The joints between panels 60, comprising a pair of adjoining rabbets 64 are filled with a suitable water containing joint compound 34. No joint tape is used. The joint compound 34 can be a quick setting material such as Easy-Sand Brand joint compound marketed by United States Gypsum Company. The joint compound 34 can be applied in two coats and thereafter be lightly sanded.

Layers 63 facing the gypsum core 62 of the board 61 are a non-woven fiberglass mat impregnated with acrylic resin, being about 0.033 inch thick. These layers 63 are highly water-resistant, being incapable of absorbing significant moisture, and are essentially impervious to water. Consequently, there is no risk that the layers 63 will absorb water or visibly swell as a result thereof.

The following is a formula for an aggregate-free, non-blocking coating or paint that can be sprayed onto the acoustical panels of the invention to provide a finish, conceal the joints therebetween and hide the perforations 28 that can otherwise show through the veil 29. The coating can be applied in two applications with the first application being lightly sanded.

| Ingredient | Percentage by Weight | Function |
|---|---|---|
| Water | 40 | Solvent |
| Surfactant | 0.1 | Surfactant for TiO2 |
| Dispersant | 0.1 | dispersant |
| Acrylic Thickener 1 | 0.5 | Viscosity modifier |
| Cellulosic Thickener 2 | 0.3 | Viscosity modifier |
| Latex Emulsion | 5 | Binder |
| Biocide | 0.2 | Preservative |
| Carbonate | 27.8 | Filler 1 |
| Filler/Pigment | 18 | Filler 2 |
| Filler/Pigment | 8 | Filler 3 |

The fillers include and are not limited to: carbonate (different particle size or morphology), clays, delaminated clays, water wash clay, nepheline syenite, TiO2, mica, talc and other known fillers used in paints.

Typically, joint compound in a finish sanded joint absorbs water to a different extent than the veil 29 and underlying face layer 23 of the gypsum board. This differential absorption rate can result in different drying rates and ultimately a difference in the final appearance of a water based paint overlying the joint areas and the remainder of the acoustical panels. This effect can be reduced by first painting the joint area covered by joint compound with a sealer, such as by using the finish coat/paint locally on the joint area and thereafter priming the whole panel installation. Subsequently, the whole installation is coated with one or two finish paint coats.

A second technique to reduce a difference in the finish paint coat over a joint filled with joint compound and main panel areas is to factory coat the acoustical panel with a primer. After the panel is installed with other panels and their joints are finished, the system is completed with one or two finish paint coats.

The foregoing disclosures, in part, involve modification of a conventional drywall sheet to convert it to the acoustical panel of the invention. However, the inventive acoustical panel can be originally manufactured with perforations in the gypsum core while it is being originally formed or immediately after it is formed and prior to attachment of one or both cover sheets or layers, if any, to its front face and rear side. The perforations, for example, can be cast into the gypsum body. The cross-section of the perforation in the various disclosed embodiments can be accircular when not drilled.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A rectangular acoustical panel comprising a drywall sheet of a thickness of at least ½ inch or metric industry equivalent having a gypsum-based core and paper front and rear face layers, the drywall sheet being perforated through its faces and core with holes at least ⅛ inch in diameter and of sufficient number to comprise at least 9% of a face area of the panel, the front face being covered by a porous non-woven glass fiber veil having a translucence rendering it incapable of fully concealing the holes, the veil being covered with a non-bridging coating, the combined veil and coating being effective to conceal the holes while affording sufficient porosity therethrough to allow the panel to exhibit an NRC of at least 0.55, short edges of the panel for forming butt joints with identical panels having locally recessed areas at a front face of the panel for reception of joint tape and joint compound below a plane of a major part of the front face of the panel.

2. An acoustical panel as set forth in claim 1, wherein the locally recessed areas are a result of the gypsum core being permanently compressed.

3. A rectangular acoustical panel comprising a drywall sheet of a thickness of at least ½ inch or metric industry equivalent having a gypsum-based core and paper front and rear face layers, the drywall sheet being perforated through its faces and core with holes at least ⅛ inch in diameter and of sufficient number to comprise at least 9% of a face area of the panel, the front face being covered by a porous non-woven glass fiber veil having a translucence rendering it incapable of fully concealing the holes, the veil being covered with a non-bridging coating, the combined veil and coating being effective to conceal the holes while affording sufficient porosity therethrough to allow the panel to exhibit an NRC of at least 0.55, short edges of the panel for forming butt joints with identical panels being machined to enable the front face at the short edges to be locally recessed when the panel area adjacent the short edge is drawn against a panel support at a rear face of the panel.

4. An acoustical panel comprising a drywall sheet of a thickness of at least ½ inch or metric industry equivalent having a gypsum-based core and front and rear face layers, the drywall sheet being perforated through its faces and core with holes at least ⅛ inch in diameter and of sufficient number to comprise at least 9% of a face area of the panel, the front face layer having water-resistant margins resistant to swelling from absorption of moisture from contact with joint compound containing water, the front face being covered by a porous non-woven glass fiber veil having a translucence rendering it incapable of fully concealing the holes, the veil being covered with a non-bridging coating, the combined veil and coating being effective to conceal the holes while affording sufficient porosity therethrough to allow the panel to exhibit an NRC of at least 0.55.

5. An acoustical panel as set forth in claim 4, wherein the entire front face layer is resistant to moisture induced swelling.

6. An acoustical panel as set forth in claim 5, wherein the front face layer is a waterproof paper resistant to moisture induced swelling.

7. An acoustical panel as set forth in claim 4, wherein the front face layer is conventional drywall paper treated with a moisture barrier.

8. An acoustical panel comprising a sheet of a thickness of at least ½ inch or metric industry equivalent having a gypsum-based core and front and rear face layers, the sheet being perforated through its faces and core with holes at least ⅛ inch in diameter and of sufficient number to comprise at least 9% of a face area of the panel, the front face layer being a water-resistant glass fiber resin binder layer that resists water penetration and swelling from absorption of moisture from contact with joint compound containing water, the front face being covered by a porous non-woven glass fiber veil having a translucence rendering it incapable of fully concealing the holes, the veil being covered with a non-bridging coating, the combined veil and coating being effective to conceal the holes while affording sufficient porosity therethrough to allow the panel to exhibit an NRC of at least 0.55.

9. An acoustical panel as set forth in claim 8, wherein a front side of the panel is formed with a peripheral rabbet adapted to receive joint compound.

10. An acoustical panel as set forth in claim 9, wherein the rear face layer is a glass fiber resin binder mat resistant to water penetration.

* * * * *